US010590586B2

(12) United States Patent
Lee et al.

(10) Patent No.: US 10,590,586 B2
(45) Date of Patent: Mar. 17, 2020

(54) WASHING MACHINE HAVING AN IMPROVED COUPLING STRUCTURE

(71) Applicant: SAMSUNG ELECTRONICS CO., LTD., Suwon-si, Gyeonggi-do (KR)

(72) Inventors: Jin Ho Lee, Seoul (KR); Kyung Han Kim, Seoul (KR); Woo Sup Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 840 days.

(21) Appl. No.: 14/446,824

(22) Filed: Jul. 30, 2014

(65) Prior Publication Data

US 2015/0042219 A1 Feb. 12, 2015

(30) Foreign Application Priority Data

Aug. 6, 2013 (KR) ..... 10-2013-0093347

(51) Int. Cl.

| | |
|---|---|
| ***D06F 37/26*** | (2006.01) |
| ***D06F 37/20*** | (2006.01) |
| ***D06F 37/04*** | (2006.01) |
| ***D06F 39/12*** | (2006.01) |
| *D06F 39/00* | (2020.01) |

(52) U.S. Cl.

CPC ..... *D06F 37/267* (2013.01); *D06F 37/04* (2013.01); *D06F 37/20* (2013.01); *D06F 39/12* (2013.01); *D06F 39/005* (2013.01)

(58) Field of Classification Search

CPC .. D06F 37/267; D06F 39/005; A47L 15/4251; A47L 15/4265; A47L 15/4293

See application file for complete search history.

(56) References Cited

U.S. PATENT DOCUMENTS 5,611,610 A * 3/1997 Katz ..... D06F 39/12 312/263

5,624,167 A 4/1997 Katz (Continued)

FOREIGN PATENT DOCUMENTS

CN 103052744 4/2013

DE 2004 022 978 A1 12/2005

(Continued)

OTHER PUBLICATIONS

KR20080056627—Machine Translation, Jun. 2008.*

(Continued)

*Primary Examiner* — Marc Lorenzi

(74) *Attorney, Agent, or Firm* — Staas & Halsey LLP

(57) ABSTRACT

A washing machine including a cabinet, a tub placed within the cabinet, a wash tub located within the tub to receive laundry therein, an element receiving unit in which elements are received, the element receiving unit being coupled to one side of the cabinet, a coupling panel provided at the element receiving unit so as to be coupled to the cabinet, a receiving panel provided at the cabinet so as to receive at least a portion of the coupling panel, a first holder and a second holder formed at the coupling panel, and a first receiving hole and a second receiving hole perforated in the receiving panel to receive the first holder and the second holder respectively therein. The coupling panel is pivotally rotated after the first holder is positioned into the first receiving hole, causing the second holder to be fitted into the second receiving hole.

12 Claims, 14 Drawing Sheets

(56) References Cited

U.S. PATENT DOCUMENTS

| | | | | | |
|---|---|---|---|---|---|
| 5,688,030 | A * | 11/1997 | McAnally | G06F 1/181 | 312/223.2 |
| 5,971,510 | A * | 10/1999 | Lickiss | D06F 39/12 | 312/228 |
| 6,141,995 | A * | 11/2000 | Johnson | D06F 39/085 | 134/188 |
| 6,371,583 | B1 * | 4/2002 | Visin | D06F 39/12 | 312/228 |
| 6,378,825 | B1 | 4/2002 | Yee et al. | | |
| 6,706,982 | B1 * | 3/2004 | Knopp | D06F 39/005 | 200/296 |
| 2005/0196294 | A1 | 9/2005 | Clark et al. | | |
| 2007/0180868 | A1 | 8/2007 | Hur | | |
| 2009/0066205 | A1 | 3/2009 | Park et al. | | |

FOREIGN PATENT DOCUMENTS

| | | | |
|---|---|---|---|
| JP | 2011-56113 | | 3/2011 |
| KR | 1999-005937 | | 2/1999 |
| KR | 10-2006-0098834 | | 9/2006 |
| KR | 10-2007-0040615 | | 4/2007 |
| KR | 10-0737315 | | 7/2007 |
| KR | 20080056627 | A * | 6/2008 |
| KR | 10-2009-0024587 | | 3/2009 |

OTHER PUBLICATIONS

International Search Report dated Nov. 20, 2014 in International Application No. PCT/KR2014/007233, 3 pages.

Chinese Office Action dated Feb. 4, 2017 in corresponding Chinese Patent Application No. 201480043983.5.

European Search Report dated Feb. 7, 2017 in corresponding European Application No. 14 83 5072.

European Intention to Grant dated Aug. 7, 2017 in corresponding European Patent Application No. 14 835 072.1.

Chinese Office Action dated Oct. 13, 2017 in corresponding Chinese Patent Application No. 201480043983.5.

Chinese Patent Office Action issued Notification of the Decision to Grant dated Feb. 22, 2018 in corresponding Chinese Patent Application No. 201480043983.5 (Total 5 pages).

* cited by examiner

WASHING MACHINE HAVING AN IMPROVED COUPLING STRUCTURE

CROSS-REFERENCE TO RELATED APPLICATIONS

This application claims the priority benefit of Korean Patent Application No. 10-2013-0093347, filed on Aug. 6, 2013 in the Korean Intellectual Property Office, the disclosure of which is incorporated herein by reference.

BACKGROUND

1. Field

Example embodiments of the present disclosure relate to a washing machine having an improved coupling structure of a cabinet and an element receiving unit.

2. Description of the Related Art

Generally, a washing machine is an apparatus that washes laundry by rotating a cylindrical rotating tub into which laundry and wash water are received or provided. Examples of washing machines include a drum washing machine in which laundry received in a horizontally installed rotating tub is washed by being lifted upward along an inner circumference of the rotating tub and dropping as the rotating tub is rotated forward and in reverse about a horizontal axis. Another example is a vertical axis washing machine in which a pulsator provided in a vertically installed rotating tub generates water stream to wash laundry as the rotating tub is rotated forward and in reverse about a vertical axis.

A typical washing machine includes a cabinet defining an external appearance of the washing machine, a cylindrical tub installed within the cabinet to receive wash water therein, and a wash tub rotatably installed within the tub to receive laundry to be washed therein. An element receiving unit in which elements required for operation of the washing machine are received may be coupled to the cabinet.

Although the element receiving unit has been assembled to the cabinet using separate fastening members, such as screws, need for the fastening members to assemble the element receiving unit causes increased product price and deteriorated production efficiency. In addition, the element receiving unit has a limited installation position and frequently tends to be separated due to external shock.

SUMMARY

It is an aspect of the present disclosure to provide a washing machine having an improved coupling structure of a cabinet and an element receiving unit, which may reduce the number of separately fastened fastening members and prevent the element receiving unit from being separated from the cabinet.

Additional aspects of the disclosure will be set forth in part in the description which follows and, in part, will be obvious from the description, or may be learned by practice of the disclosure.

In accordance with one aspect of the disclosure, a washing machine includes a cabinet, a tub placed within the cabinet, a wash tub located within the tub to receive laundry therein, an element receiving unit in which various elements are received, the element receiving unit being coupled to one side of the cabinet, a coupling panel provided at the element receiving unit so as to be coupled to the cabinet, a receiving panel provided at the cabinet so as to receive at least a portion of the coupling panel, a first holder and a second holder formed at the coupling panel, and a first receiving hole and a second receiving hole perforated in the receiving panel to receive the first holder and the second holder respectively therein, wherein the coupling panel is pivotally rotated after the first holder is located in the first receiving hole, causing the second holder to be fitted into the second receiving hole.

Each of the first receiving hole and the second receiving hole may include a first circle and a second circle such that the first holder and the second holder are separably fitted into the first receiving hole and the second receiving hole, and the first circle and the second circle may have different sizes.

The first and second circles of the first receiving hole may be oriented in a direction from that of the first and second circles of the second receiving hole.

At least a portion of each of the first holder and the second holder may have a circular form such that the first holder and the second holder correspond to the first receiving hole and the second receiving hole respectively.

The first holder may be located close to a rear end of the coupling panel, and the second holder may be located close to a front end of the coupling panel.

The washing machine may further include at least one protrusion protruding from a longitudinal edge of the coupling panel.

The at least one protrusion may include a first protrusion formed on at least one of the holders.

The washing machine may further include a separation prevention bump protruding from the first protrusion toward the receiving panel to prevent the at least one holder from being separated from the corresponding receiving hole.

The element receiving unit may be coupled to the center of the receiving panel.

The washing machine may further include a rib protruding upward from the receiving panel to couple the element receiving unit and the coupling panel to each other as a fastening member is fastened through the rib.

The element receiving unit may receive various elements required for operation of the washing machine, including a printed circuit board.

Upon coupling of the element receiving unit and the cabinet, the element receiving unit may be prevented from being separated from the cabinet during operation of the washing machine.

Upon lifting the first protrusion, the separation prevention bump may be released from the corresponding receiving hole.

In accordance with another aspect of the disclosure, a washing machine includes a cabinet, a tub placed within the cabinet, a wash tub rotatably placed within the tub to receive laundry therein, an element receiving unit in which various elements are received, the element receiving unit being coupled to one side of the cabinet, a coupling panel provided at the element receiving unit so as to be coupled to the cabinet, a receiving panel provided at the cabinet so as to receive at least a portion of the coupling panel, a first holder and a second holder formed at the coupling panel, and a first receiving hole and a second receiving hole perforated in the receiving panel to receive the first holder and the second holder respectively therein, wherein the first receiving hole is oriented in a first direction and the second receiving hole is oriented in a second direction different from the first direction.

Each of the first receiving hole and the second receiving hole may include a first circle and a second circle, and the first circle and the second circle may have different sizes, and at least a portion of each of the first holder and the second holder may have a circular form such that the first holder and the second holder are received in the first circle and the second circle respectively.

A diameter of the first circle may be greater than a diameter of the second circle.

Each of the first holder and the second holder may be received in the first circle and fitted into the second circle to couple the coupling panel and the receiving panel to each other.

The washing machine may further include at least one protrusion protruding from a longitudinal edge of the coupling panel.

The at least one protrusion may include a first protrusion formed on at least one of the holders.

The first holder may be located close to a rear end of the coupling panel, and the second holder may be located close to a front end of the coupling panel, and the first protrusion may be provided at the second holder.

The washing machine may further include a separation prevention bump protruding from the first protrusion toward the receiving panel to prevent the second holder from being separated from the second receiving hole.

In accordance with a further aspect of the disclosure, a washing machine includes a cabinet, a tub placed within the cabinet, a wash tub placed within the tub to receive laundry therein, an element receiving unit in which various elements are received, the element receiving unit being coupled to one side of the cabinet, a first holder and a second holder formed at one surface of the element receiving unit, and a first receiving hole and a second receiving hole perforated in at least a portion of the cabinet to receive the first holder and the second holder respectively therein, wherein the element receiving unit is coupled to the cabinet via a first state in which the first holder is received in the first receiving hole, a second state in which the first holder is fitted into the first receiving hole, and a third state in which the second holder is fitted into the second receiving hole.

Each of the first receiving hole and the second receiving hole may include a first circle and a second circle having different sizes.

The first holder may be received in the first circle of the first receiving hole in the first state and may be fitted into the second circle of the first receiving hole in the second state, and the second holder may be received in the first circle of the second receiving hole in the second state and may be fitted into the second circle of the second receiving hole in the third state.

The second holder may further include a separation prevention bump protruding toward the receiving panel to prevent the second holder from being separated from the second receiving hole, and the separation prevention bump may be inserted into the first circle of the second receiving hole in the third state.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
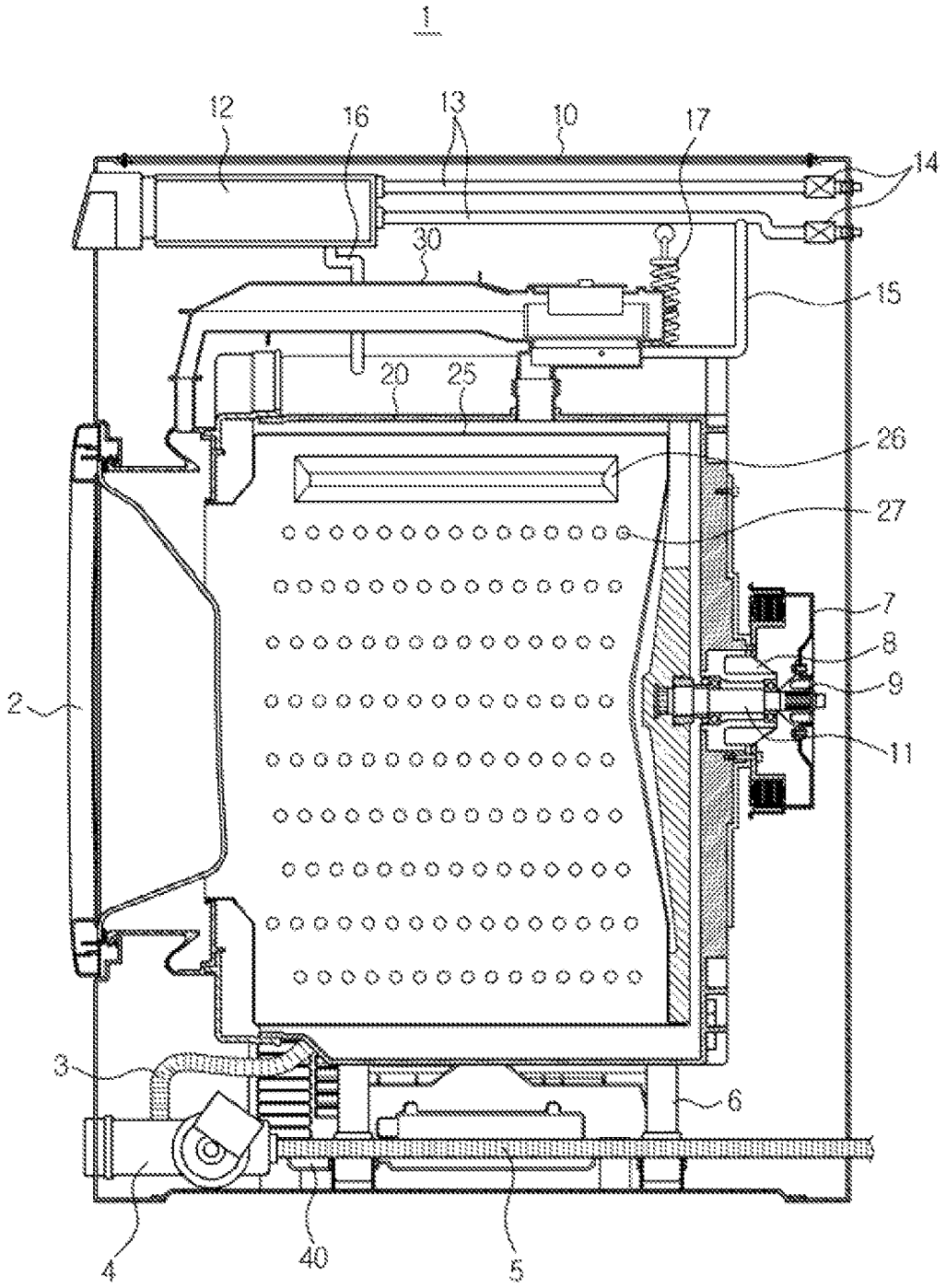
FIG. 1 is a cross sectional view of a washing machine in accordance with an example embodiment of the present disclosure.

Reference will now be made in detail to the embodiments of the present disclosure, examples of which are illustrated in the accompanying drawings, wherein like reference numerals refer to like elements throughout. Although a drum washing machine will hereinafter be described by way of example, the embodiments are not limited thereto and may be applied with regard to a coupling structure of an element receiving unit and a cabinet of the washing machine.

Figure 2:
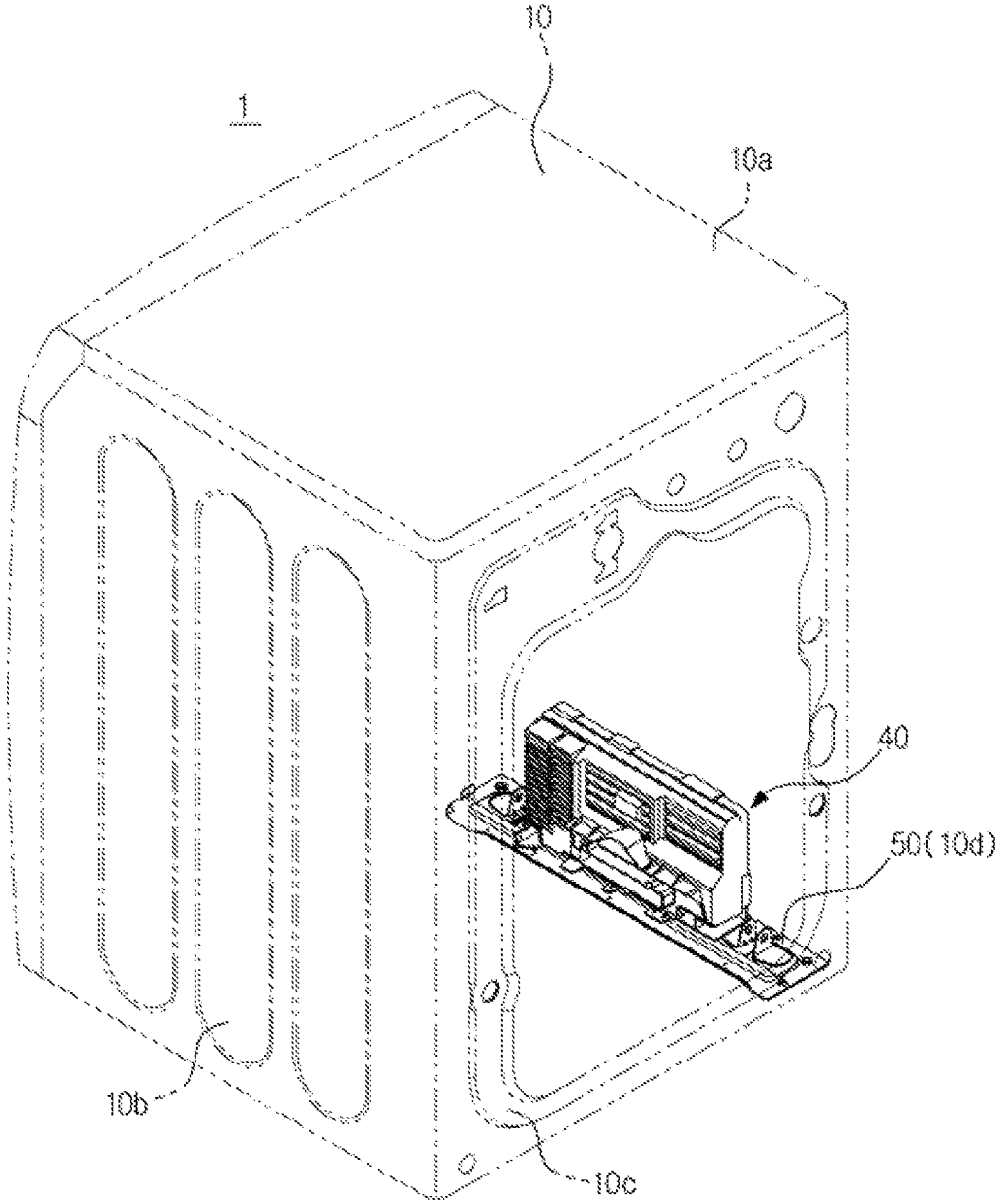
FIG. 2 is a view illustrating an element receiving unit coupled to the washing machine in accordance with an example embodiment of the present disclosure.

FIG. 1 is a cross sectional view of a washing machine in accordance with an example embodiment of the present disclosure, and FIG. 2 is a view illustrating an element receiving unit coupled to the washing machine in accordance with an example embodiment of the present disclosure.

As exemplarily shown in FIGS. 1 and 2, the washing machine 1 includes a cabinet 10, a tub 20 placed within the cabinet 10, a wash tub 25 rotatably placed within the tub 20 to receive laundry therein, and a motor 7 to drive the wash tub 25.

As shown in FIG. 2, the cabinet 10 may include frames 10*a*, 10*b*, 10*c*, and 10*d*. The frames 10*a*, 10*b*, 10*c*, and 10*d* may include a front frame (not shown) and a rear frame 10*c* defining front and rear faces of the cabinet 10, respectively, and a lateral frame 10*b* and a bottom frame 10*d* connecting the front frame (not shown) and the rear frame 10*c* to each other and defining lateral and bottom faces of the cabinet 10 respectively.

An element receiving unit 40 in which various elements are received for operation of the washing machine may be coupled to one side of the cabinet 10. According to an example embodiment of the present disclosure, the element receiving unit 40 in which various elements are received may be coupled to one edge of the bottom frame 10*d*. The bottom frame 10*d*, to which the element receiving unit 40 may be coupled, is referred to as a receiving panel 50. The coupling of the element receiving unit 40 to the bottom frame 10*d* is exemplary, and thus, the present disclosure is not limited thereto. As such, the element receiving unit 40 may be coupled to other areas.

Various elements required for operation of the washing machine 1 may be received in the element receiving unit 40. In one example, according to an embodiment of the present disclosure, a printed circuit board (not shown) may be received in the element receiving unit 40.

The front frame (not shown) of the cabinet 10 may have an opening for introduction of laundry into the wash tub 25. The opening may be opened or closed by a door 2 installed to the front frame (not shown) of the cabinet 10.

A spring 17 may be interposed between the tub 20 and the cabinet 10 to support the top of the wash tub 25. The spring 17 serves to elastically alleviate vibration and noise generated by movement of the tub 20.

A second water supply pipe 13 to supply wash water into the tub 20 may be installed above the tub 20. A first water supply pipe 15 may be connected to one side of a drying duct 30. One end of the second water supply pipe 13 may be connected to an external water supply source (not shown), and the other end of the second water supply pipe 13 may be connected to a detergent supply device 12. A supply valve 14 to control wash water may be installed the second water supply pipe 13.

The detergent supply device 12 may be connected to the tub 20 via a connector 16. Water supplied through the second water supply pipe 13 may be directed into the tub 20 along with detergent by way of the detergent supply device 12.

The tub 20 may be supported by a damper 6. The damper 6 may connect an inner bottom surface of the cabinet 10 and an outer surface of the tub 20 to each other. Instead of being installed at the inner bottom surface of the cabinet 10, the damper 6 may also be installed at an inner ceiling surface or an inner left or right surface of the tub 20 to support the tub 20. The damper 6 or the spring 17 may alleviate vibration and shock generated by vertical movement of the tub 20 at the top and bottom of the tub 20.

According to an example embodiment of the present disclosure, a drive shaft 11 may be connected to a rear surface of the wash tub 25 to transmit power of the motor 7. A plurality of through-holes 27 for passage of wash water is perforated in the circumference of the wash tub 25. A plurality of lifters 26 is installed at an inner circumferential surface of the wash tub 25 to allow laundry to be lifted and dropped during rotation of the wash tub 25.

The drive shaft 11 may be interposed between the wash tub 25 and the motor 7. One end of the drive shaft 11 may be connected to a rear wall of the wash tub 25 and the other end of the drive shaft 11 may extend outward from a rear wall of the tub 20. When the motor 7 drives the drive shaft 11, the wash tub 25 connected to the drive shaft 11 is rotated about the drive shaft 11.

A bearing housing 8 is installed to a rear surface of the tub 20 to rotatably support the drive shaft 11. The bearing housing 8 may be formed of an aluminum alloy, and may be inserted into the rear wall of the tub 20 during injection molding of the tub 20. Bearings 9 may be interposed between the bearing housing 8 and the drive shaft 11 to ensure smooth rotation of the drive shaft 11.

Provided below the tub 20 are a drain pump 4 to discharge water from the interior of the tub 20 to the outside of the cabinet 10, a connection hose 3 connecting the tub 20 and the drain pump 4 to each other to allow water within the tub 20 to be introduced into the drain pump 4, and a drain hose 5 to guide water pumped by the drain pump 4 to the outside of the cabinet 10.

The tub 20 is provided with a drying device, which dries air discharged from the tub 20 and resupplies the air into the tub 20. According to an example embodiment of the present disclosure, condensation of moisture in the air by the drying device is implemented within the tub 20, and the drying duct 30 constituting the drying device functions to heat the condensed air and supply the same into the wash tub 25.

Figure 3:
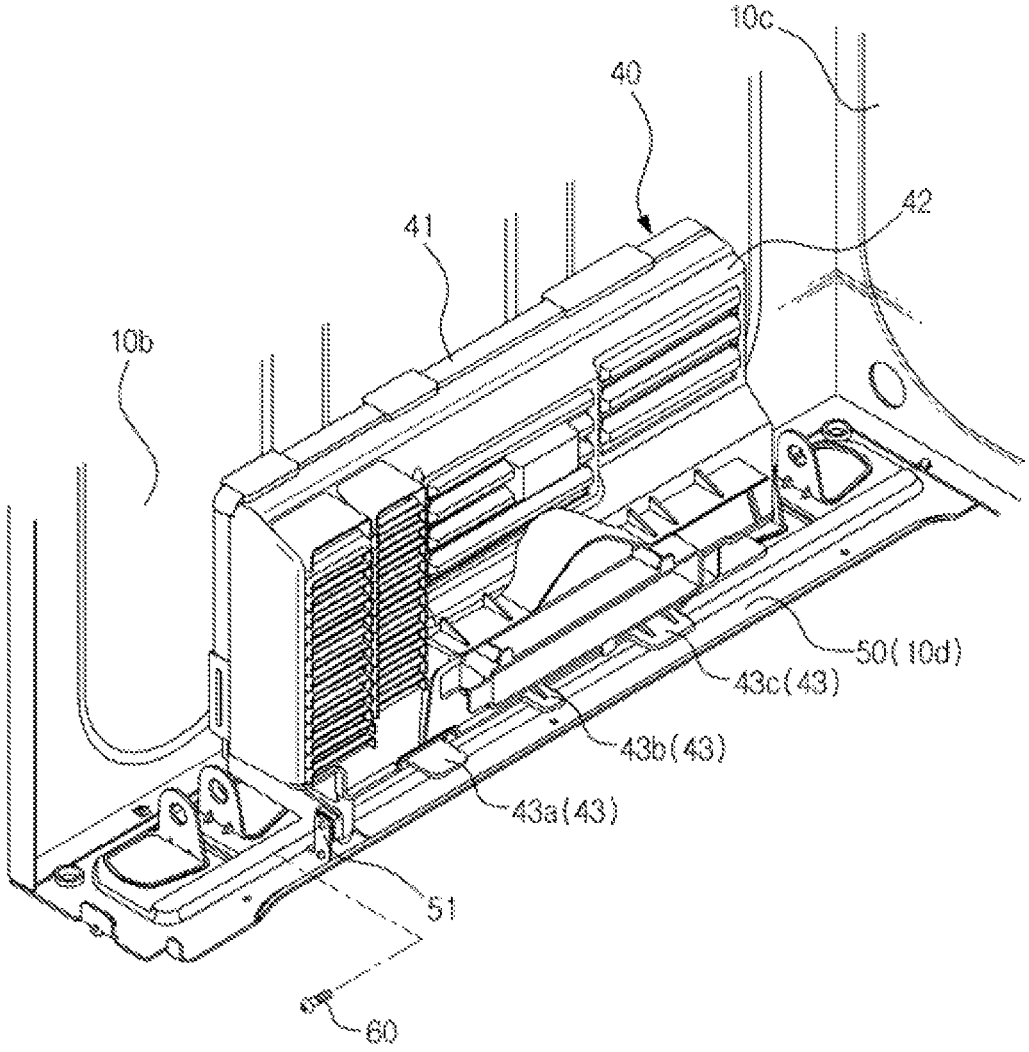
FIG. 3 is an enlarged view showing the element receiving unit coupled to a cabinet of the washing machine in accordance with an example embodiment of the present disclosure.
Figure 4:
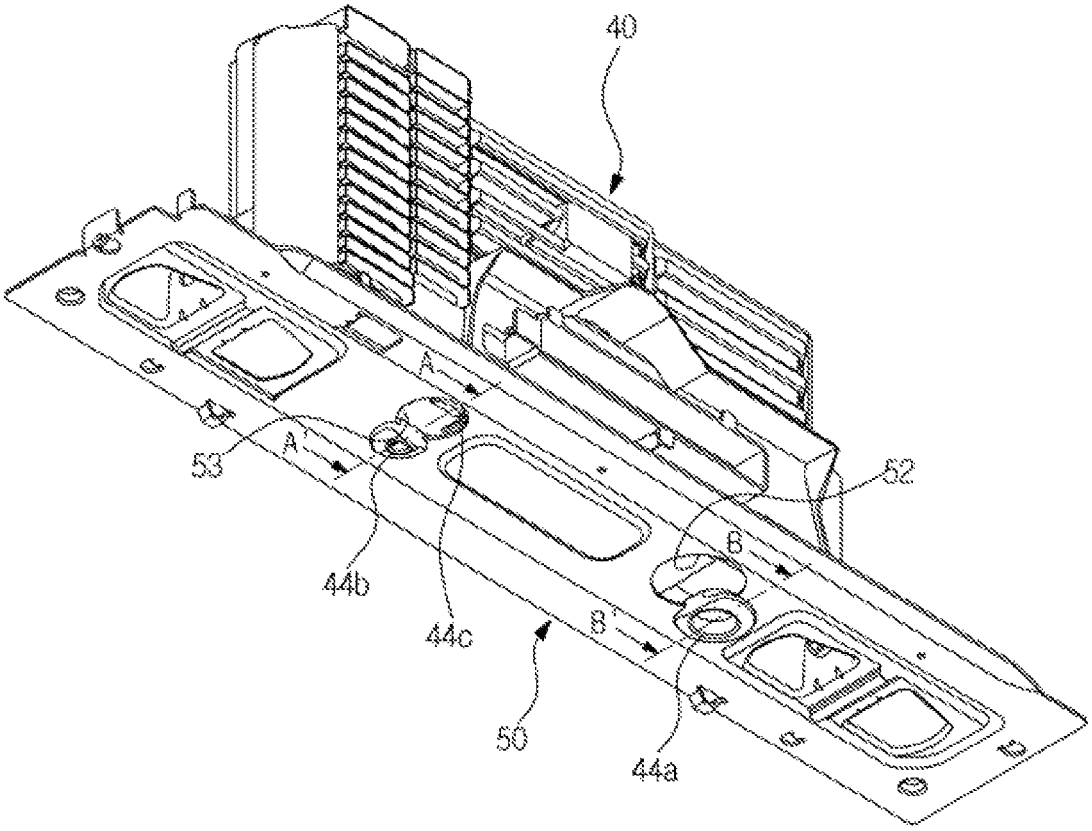
FIG. 4 is a view illustrating the element receiving unit coupled to the cabinet of the washing machine in accordance with an example embodiment of the present disclosure when viewed at a different angle from FIG. 3.

FIG. 3 is an enlarged view illustrating the element receiving unit 40 coupled to the cabinet of the washing machine in accordance with an example embodiment of the present disclosure, and FIG. 4 is a view showing the element receiving unit 40 coupled to the cabinet of the washing machine in accordance with an example embodiment of the present disclosure when viewed at a different angle from FIG. 3.

As exemplarily shown in FIGS. 3 and 4, the element receiving unit 40 is coupled to one side of the cabinet 10. One face of the element receiving unit 40 coupled to the cabinet 10 is referred to as a coupling panel (45, see FIG. 5), and one face of the cabinet 10 coupled to the element receiving unit 40 is referred to as the receiving panel 50. According to an example embodiment of the present disclosure, the receiving panel 50 is provided at the bottom frame 10*d*, however, the present disclosure is not limited thereto, and thus, the receiving panel 50 may be provided at the front frame (not shown) or the lateral frame 10*b*. In this case, the element receiving unit 40 may be coupled to the front face or the lateral face of the cabinet 10. In addition, the receiving panel 50 may be separate from the bottom frame 10*d*. In this case, the receiving panel 50 may be coupled to the bottom frame 10*d*, and may be spaced apart from the bottom frame 10*d*.

The element receiving unit 40 may include a housing 42 and a cover 41 coupled to the housing 42. The coupling panel 45 may define a portion of the housing 42. According to an example embodiment of the present disclosure, the coupling panel 45 may define a lower face of the element receiving unit 40.

According to an example embodiment of the present disclosure, the element receiving unit 40 may be coupled to the center of the receiving panel 50. That is, the element receiving unit 40 may not be located at either edge of the receiving panel 50. According to an example embodiment of the present disclosure, this is because the element receiving unit 40 may not need to be coupled to the front frame (not shown) or the rear frame 10*c* via fastening members (not shown). This will be described below.

The element receiving unit 40 may include one or more protrusions 43 protruding from a longitudinal edge part of the coupling panel 45. According to an example embodiment of the present disclosure, when the element receiving unit 40 is coupled to the cabinet 10, the protrusions 43 may protrude inward within the cabinet 10. Although three protrusions 43*a*, 43*b*, and 43*c* may be provided with the shape shown in FIG. 3 according to one example embodiment of the present disclosure, the number and shape of the protrusions is not limited thereto. The protrusions 43 serve to assist a user in lifting the element receiving unit 40 from the receiving panel 50 when separating the element receiving unit 40 from the cabinet 10. To this end, the protrusions 43 may be formed of a flexible material.

The coupling panel 45 may have a first holder 44*a* and a second holder 44*b*, and the receiving panel 50 may have a first receiving hole 52 and a second receiving hole 53 into which the first holder 44*a* and the second holder 44*b* are respectively received. That is, the first holder 44*a* is inserted into the first receiving hole 52, and the second holder 44*b* is inserted into the second receiving hole 53.

Figure 5:
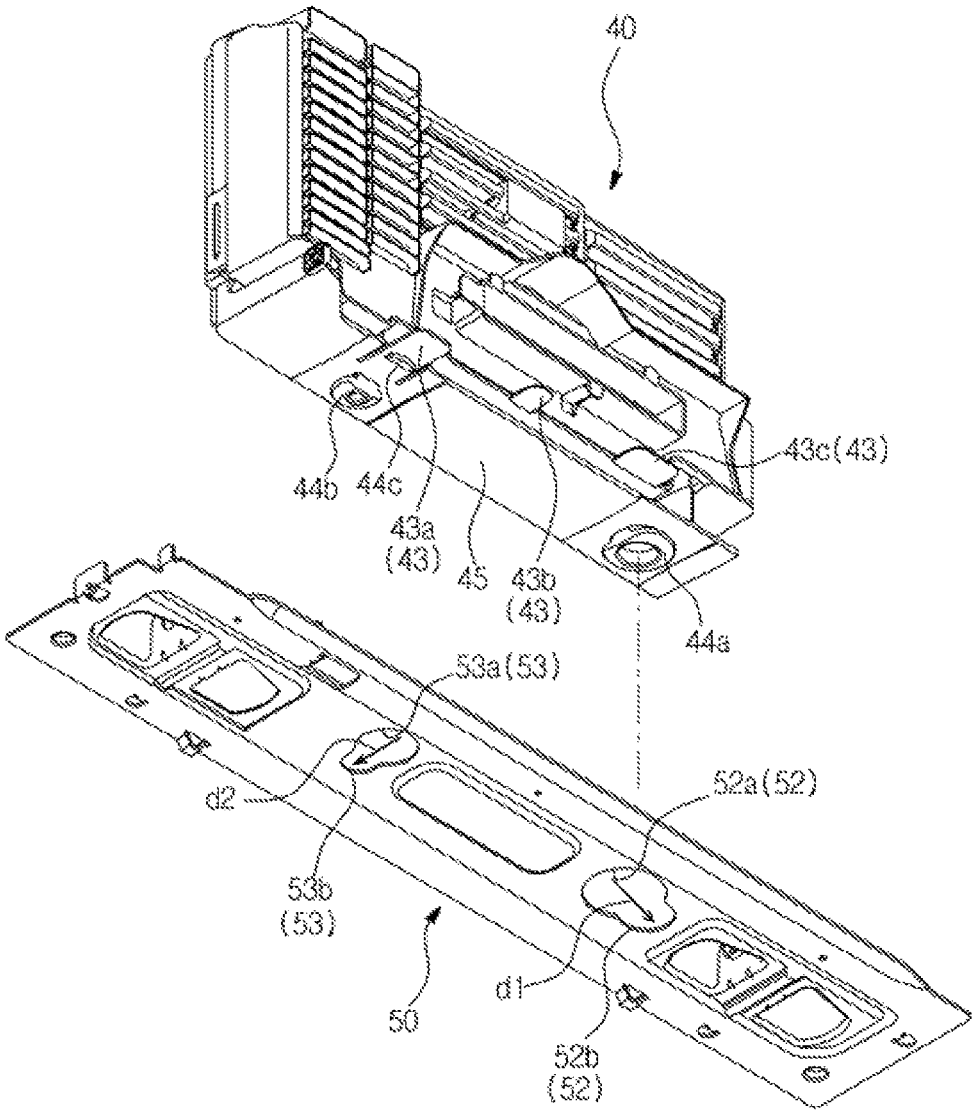
FIG. 5 is an exploded perspective view illustrating the element receiving unit and the cabinet of the washing machine in accordance with an example embodiment of the present disclosure.

The first holder 44*a* may be located close to a rear end of the coupling panel 45, and the second holder 44*b* may be located close to a front end of the coupling panel 45, as shown in FIG. 5. As such, upon assembly, the first holder

44*a* located in the back of the cabinet 10 may first be inserted into the first receiving hole 52, and thereafter the second holder 44*b* may be inserted into the second receiving hole 53. However, the present disclosure is not limited to the positioning of the first holder 44*a* and the second holder 44*b* as shown in FIG. 5.

The first receiving hole 52 and the second receiving hole 53 may have different orientations. This will be further described below.

The receiving panel 50 may further include an upwardly protruding rib 51. As a fastening member 60 is fastened through the rib 51, the receiving panel 50 and the coupling panel 45 may be coupled to each other. However, according to an example embodiment of the present disclosure, the rib 51 may not be necessary and may be a preparatory element.

Figure 6A:
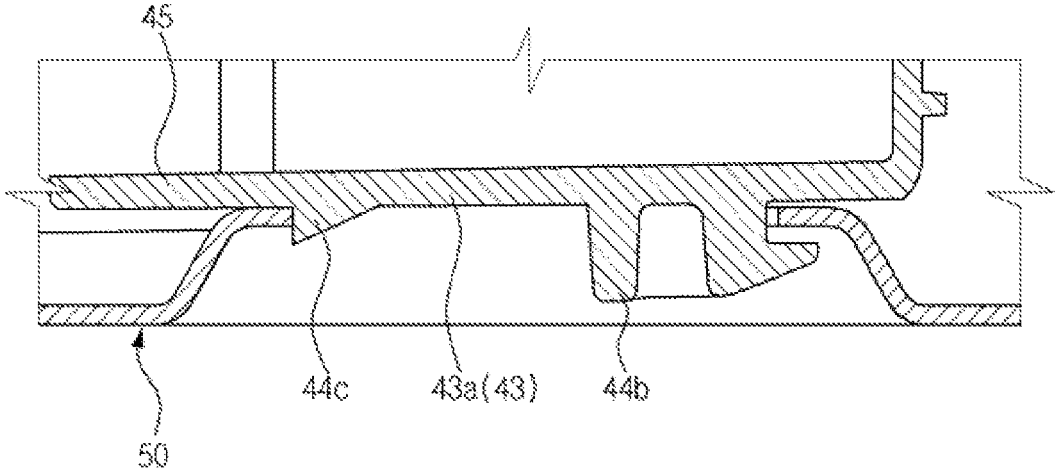
FIGS. 6A and 6B are sectional views taken along line A-A' and line B-B' of FIG. 4 respectively.
Figure 6B:
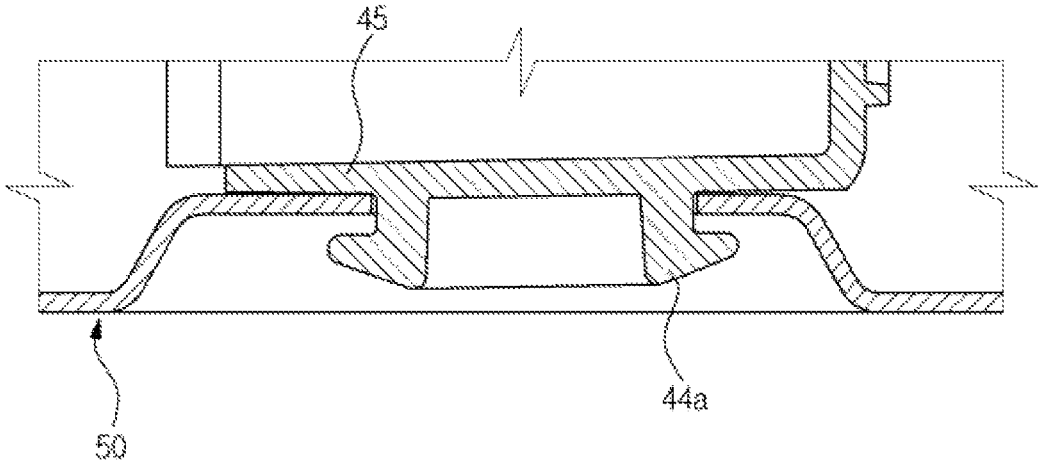

FIG. 5 is an exploded perspective view illustrating the element receiving unit 40 and the cabinet of the washing machine in accordance with an example embodiment of the present disclosure, and FIGS. 6A and 6B are sectional views taken along line A-A' and line B-B' of FIG. 4, respectively.

As exemplarily shown in FIGS. 5, 6A and 6B, the receiving panel 50 has the first receiving hole 52 and the second receiving hole 53. The first receiving hole 52 and the second receiving hole 53 may include first circles 52*a* and 53*a*, respectively, and second circles 52*b* and 53*b*, respectively. That is, the first receiving hole 52 may be formed such that the first circle 52*a* and the second circle 52*b* partially overlap each other and the second receiving hole 53 may be formed such that the first circle 53*a* and the second circle 53*b* partially overlap each other. As such, the first receiving hole 52 and the second receiving hole 53 may have a roly poly form or "8"-shaped form. The first circles 52*a*, 53*a* may have a different size from that of the second circles 52*b*, 53*b*. According to an example embodiment of the present disclosure, the first circles 52*a*, 53*a* are greater in size than the second circles 52*b*, 53*b*. As such, the respective holders 44*a*, 44*b* may be seated through the first circles 52*a*, 53*a* and are fitted into the second circles 52*b*, 53*b*, which may prevent the holders 44*a*, 44*b* from being easily separated from the receiving holes 52, 53.

Moreover, referring to FIG. 5, the first receiving hole 52 and the second receiving hole 53 may have different orientations. According to an example embodiment of the present disclosure, the first receiving hole 52 may be oriented in a first direction d1, and the second receiving hole 53 may be oriented in a second direction d2 different from the first direction d1. More specifically, the first direction d1 may be a direction from the first circle 52*a* to the second circle 52*b* of the first receiving hole 52, and the second direction d2 may be a direction from the first circle 53*a* to the second circle 53*b* of the second receiving hole 53. The first direction d1 may approximately correspond to a longitudinal direction of the rectangular receiving panel 50, and the second direction d2 may approximately correspond to a transversal direction of the rectangular receiving panel 50. Through this arrangement, as the element receiving unit 40 is pivotally rotated after the first holder 44*a* is seated and fitted into the first receiving hole 52, the second holder 44*b* may be fitted into the second receiving hole 53.

At least a portion of each of the first holder 44*a* and the second holder 44*b* may have a circular form because the first holder 44*a* and the second holder 44*b* have shapes corresponding to the first receiving hole 52 and the second receiving hole 53. In addition, according to an example embodiment of the present disclosure, the first holder 44*a* may be oriented in the first direction d1, and the second holder 44*b* may be oriented in the second direction d2.

Further, at least one of the protrusions 43 may be formed on at least one of the holders 44*a*, 44*b*. For example, this protrusion is referred to as a first protrusion 43*a*. According to an example embodiment of the present disclosure, the first protrusion 43*a* may be located at the second holder 44*b*, however, the present disclosure is not limited thereto.

A separation prevention bump 44*c* may protrude from the first protrusion 43*a* toward the receiving panel 50 to prevent the holders 44*a*, 44*b* from being separated from the receiving holes 52, 53. For example, the separation prevention bump 44*c* may be received in the second receiving hole 53. More specifically, the first protrusion 43*a* is fitted into the second circle 53*b* of the second receiving hole 53, and the separation prevention bump 44*c* is inserted into the first circle 53*a* of the second receiving hole 53. Since the separation prevention bump 44*c* has a hook-coupling relationship with the second receiving hole 53, it may be possible to prevent the element receiving unit 40 from being separated from the cabinet 10 even when the washing machine 1 vibrates.

Figure 7A:
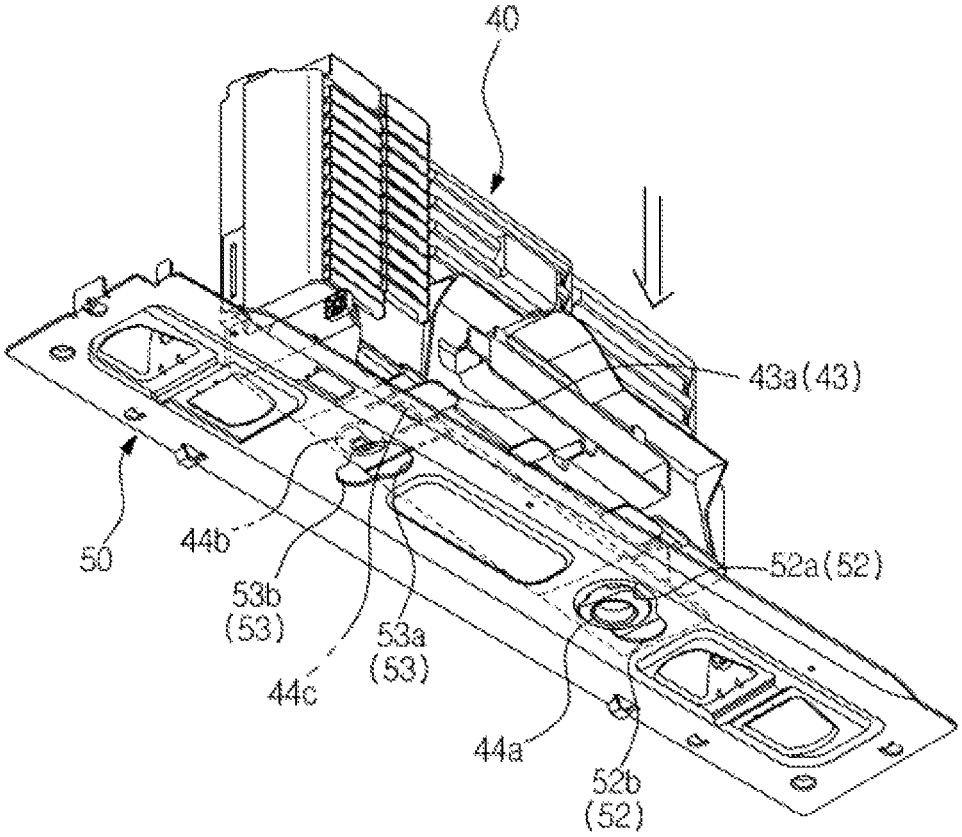
FIGS. 7A to 7C are perspective views illustrating the sequence of coupling the element receiving unit to the cabinet in accordance with an example embodiment of the present disclosure.
Figure 7B:
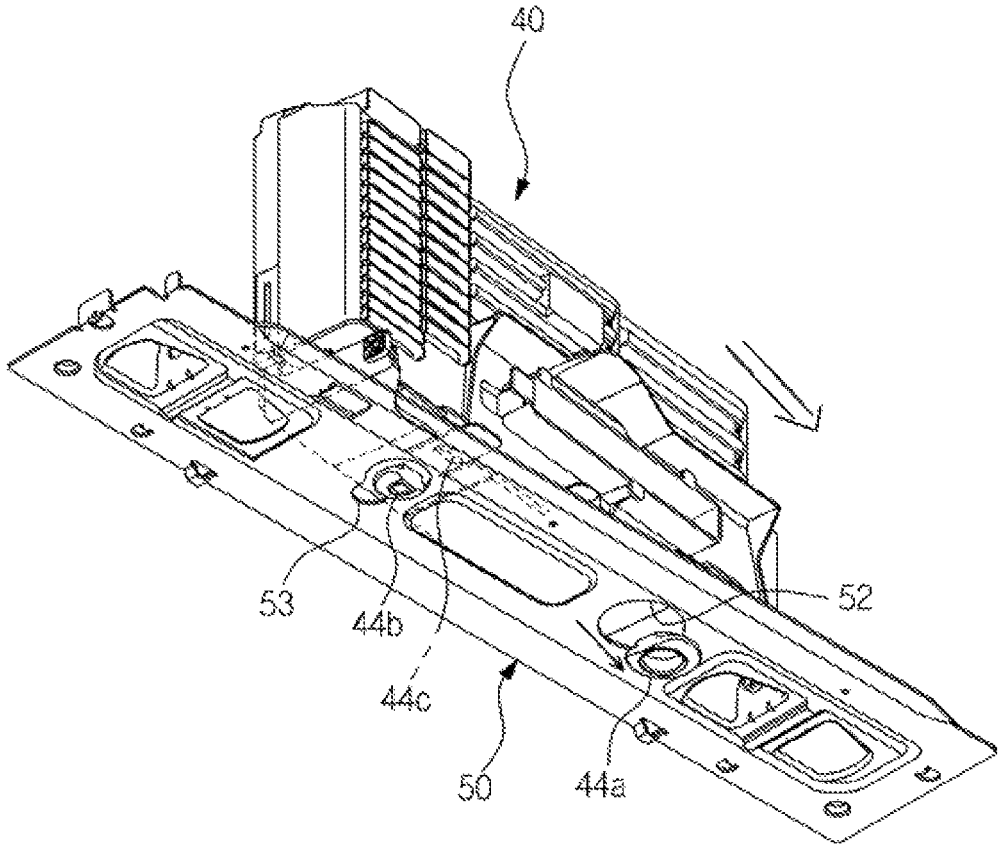
Figure 7C:
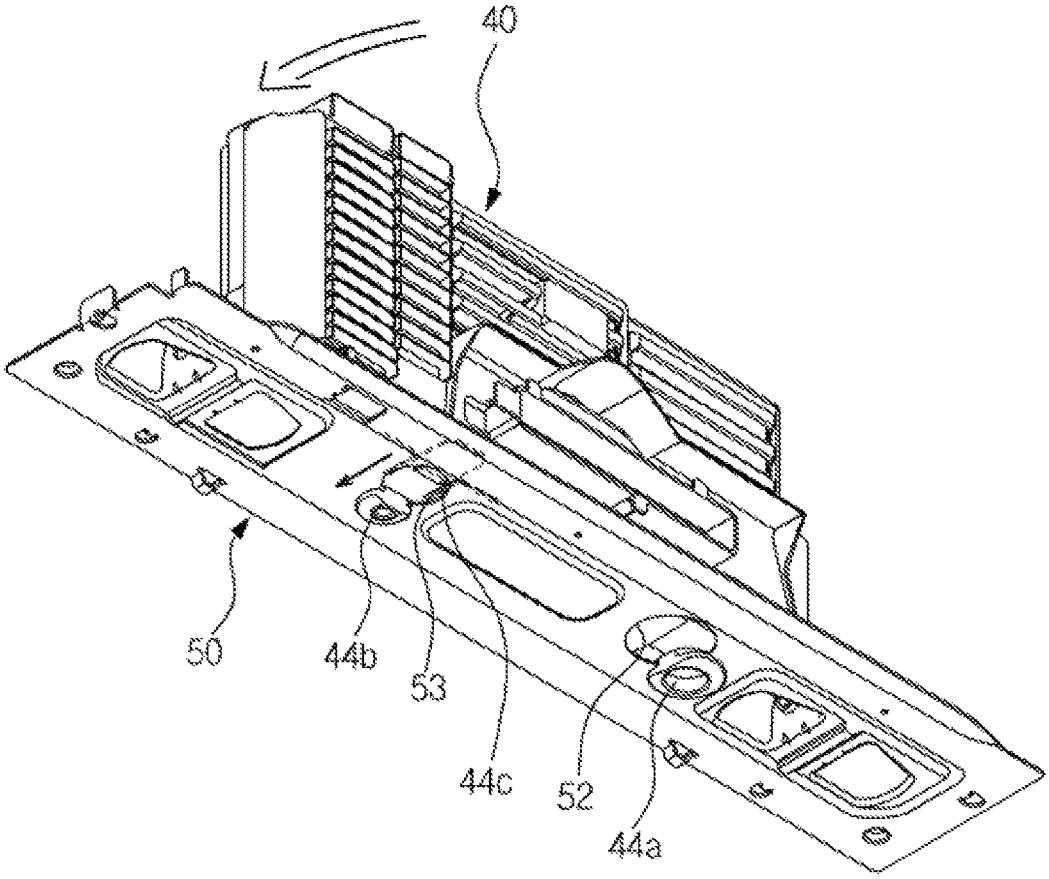
Figure 8A:
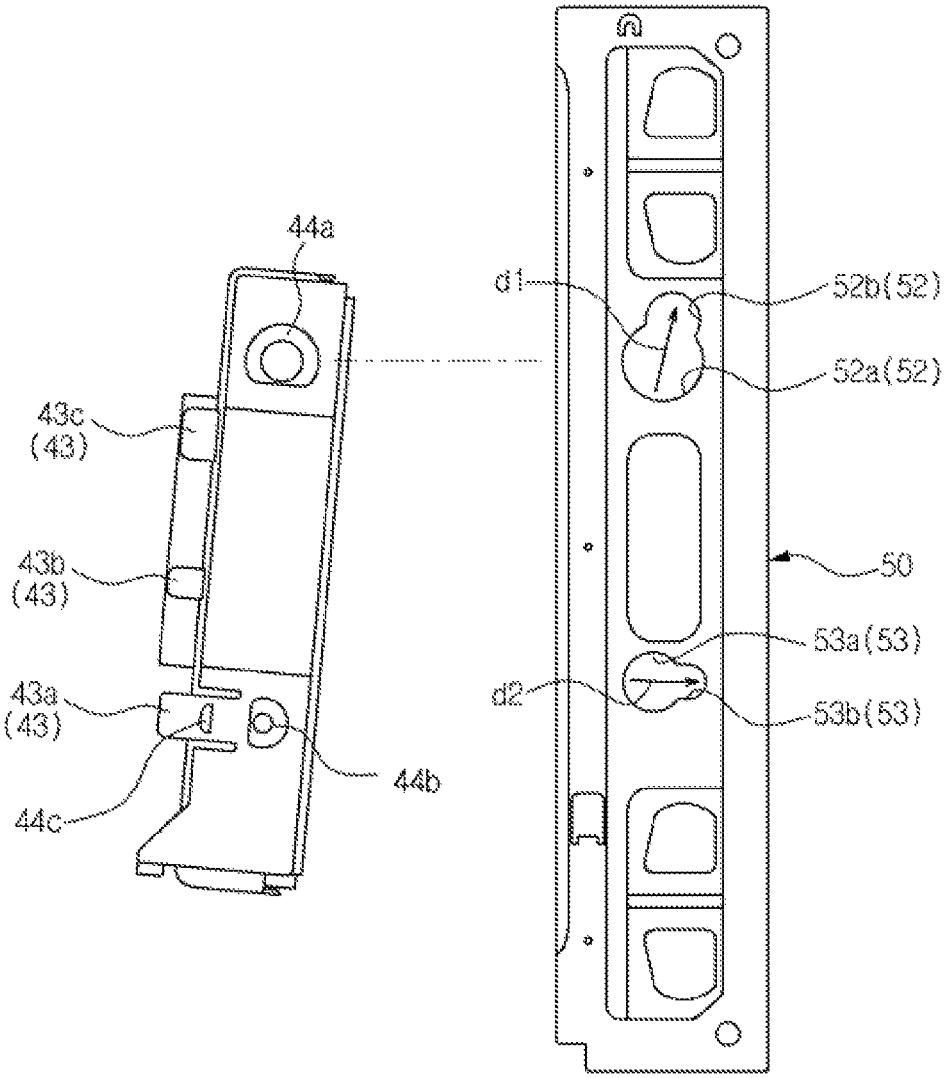
FIGS. 8A to 8D are views illustrating the sequence of coupling the element receiving unit to the cabinet in accordance with an example embodiment of the present disclosure when viewed at a different angle from FIGS. 7A-7C.
Figure 8B:
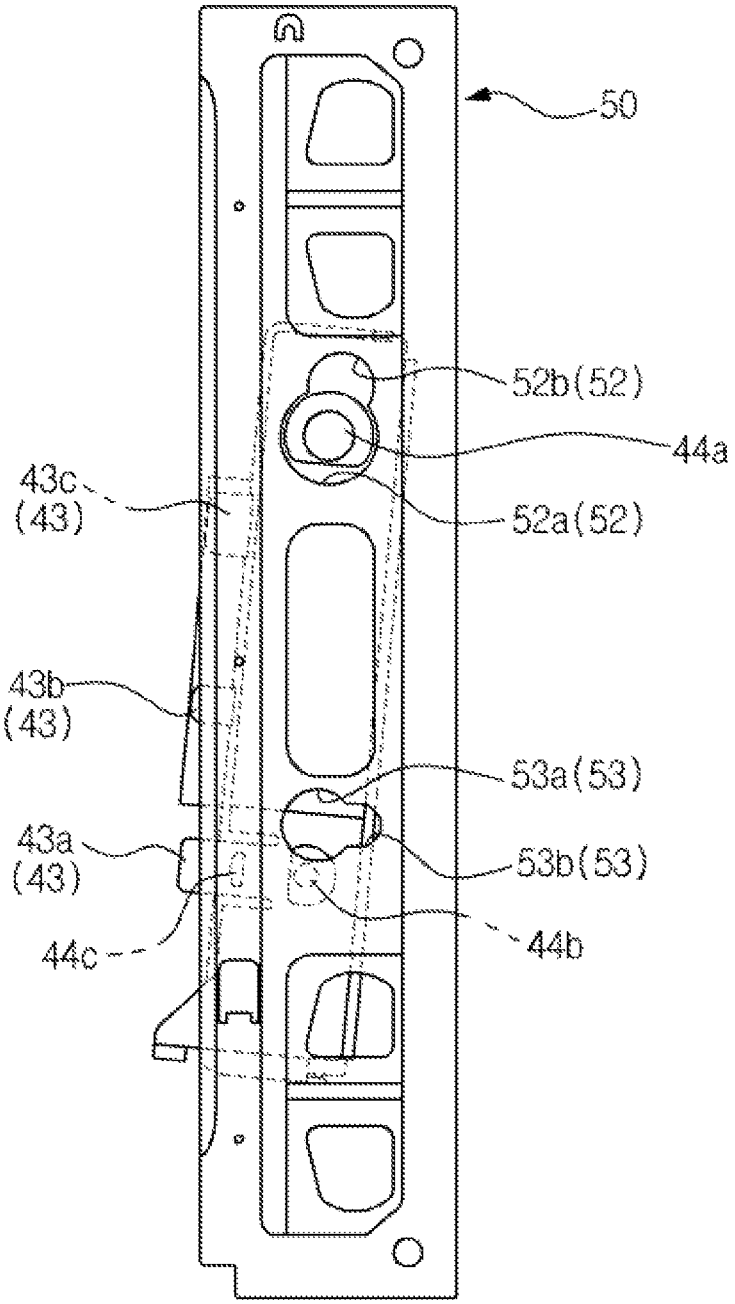
Figure 8C:
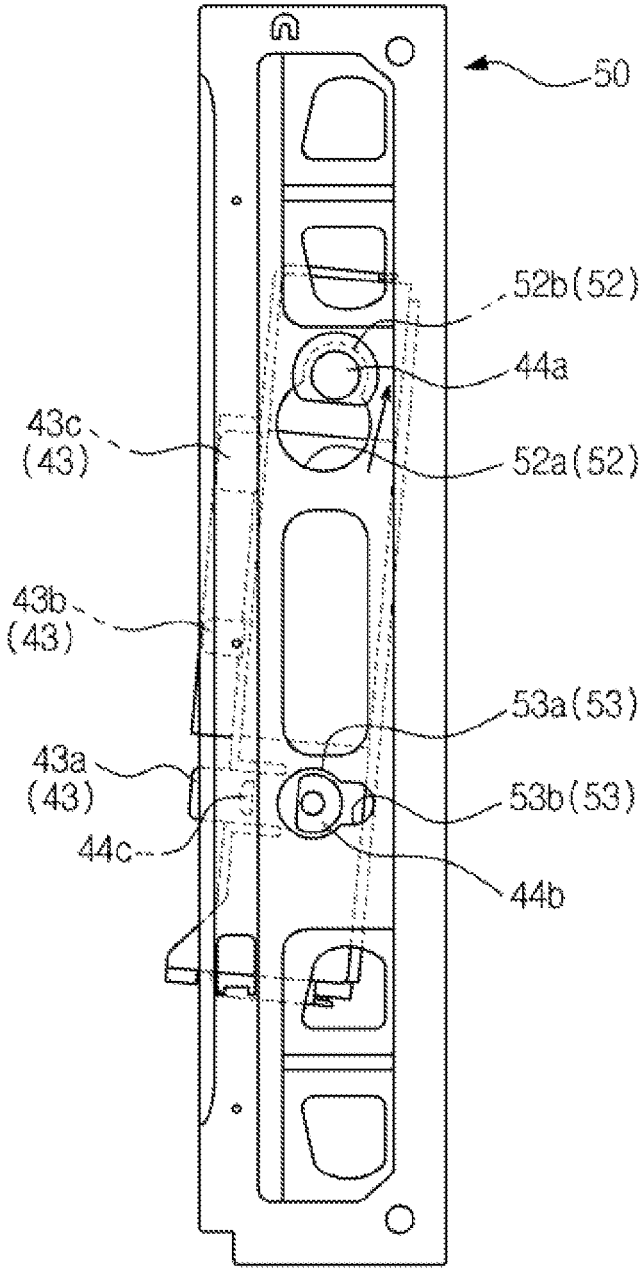
Figure 8D:
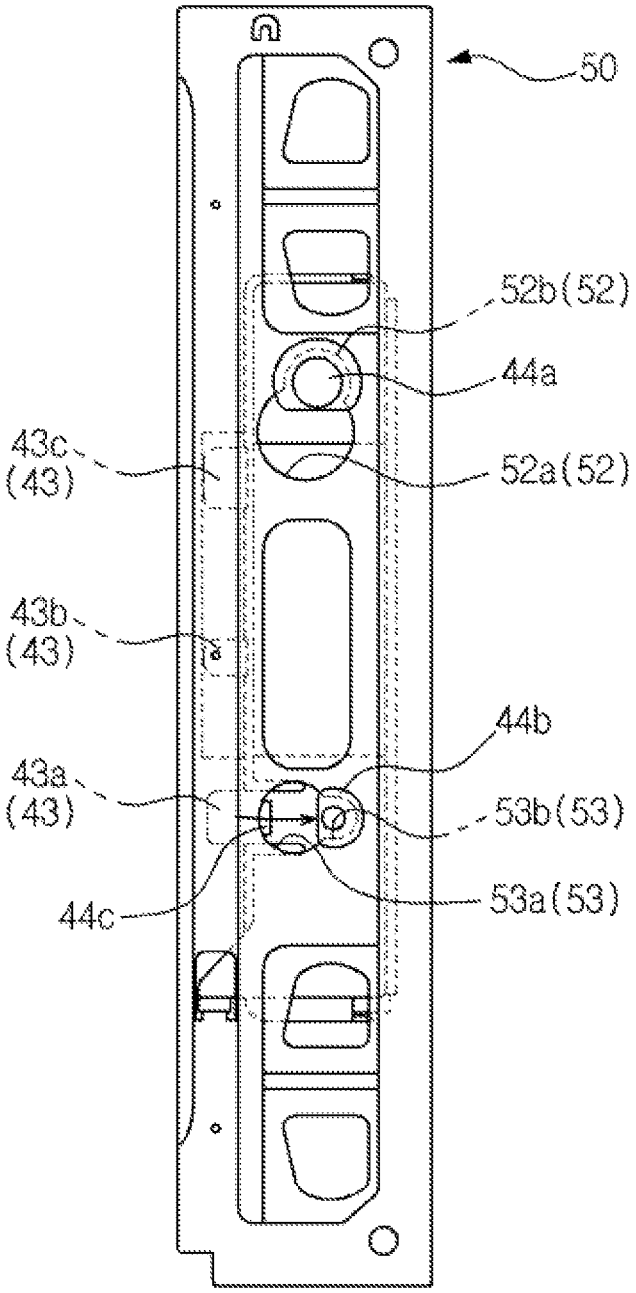

FIGS. 7A-7C are perspective views illustrating the sequence of coupling the element receiving unit to the cabinet in accordance with an example embodiment of the present disclosure, and FIG. 8 is a perspective view showing the sequence of coupling the element receiving unit to the cabinet in accordance with an example embodiment of the present disclosure when viewed at a different angle from FIGS. 7A-7C.

FIG. 7A is a view illustrating a state in which the first holder 44*a* of the element receiving unit 40 is received in the first circle 52*a* of the first receiving hole 52. This state corresponds to FIG. 8B. In this case, the second holder 44*b* is not yet received in the second receiving hole 53. This is referred to as a first state.

FIG. 7B is a view illustrating a state in which the first holder 44*a* is fitted into the first receiving hole 52. This state corresponds to FIG. 8C, and is referred to as a second state. Through movement of the element receiving unit 40, the first holder 44*a* is moved to the second circle 52*b* of the first receiving hole 52 and is thereby fitted into the first receiving hole 52. Simultaneously, the second holder 44*b* may be received in the first circle 53*a* of the second receiving hole 53.

FIG. 7C is a view illustrating a state in which the second holder 44*b* is fitted into the second receiving hole 53. This state corresponds to FIG. 8D and is referred to as a third state. As the element receiving unit 40 is pivotally rotated toward a wall surface of the cabinet 10 from the state shown in FIG. 7B, the second holder 44*b* is located in the second circle 53*b* of the second receiving hole 53 and thereby is fitted into the second receiving hole 53. In addition, the separation prevention bump 44*c* may be inserted into the first circle 53*a* of the second receiving hole 53.

When attempting to separate the element receiving unit 40 from the cabinet 10, the user may first separate the separation prevention bump 44*c* from the first circle 53*a* of the second receiving hole 53 by lifting the first protrusion 43*a*, and thereafter separate the element receiving unit 40 from the cabinet 10, for example, in a reverse order from the order described in FIGS. 7A-7C.

In this case, since the element receiving unit 40 is coupled to the cabinet 10 via the first holder 44*a* and the second holder 44*b*, the fastening member 60 may not be necessary, however, it is available depending on embodiments. Although four fastening members have conventionally been used, only one fastening member 60 may be used and use of the fastening member 60 may not even be necessary, according to an example embodiment of the present disclosure. In addition, coupling of the element fixing unit 40 may be possible so long as the cabinet 10 is provided with the receiving holes 52, 53 at positions corresponding to the holders 44*a*, 44*b* of the element fixing unit 40. Thus, the element fixing unit 40 has no limit in terms of an installation position thereof.

As is apparent from the above description, a washing machine in accordance with the embodiment of the present disclosure has an improved coupling structure of a cabinet and an element receiving unit to enable coupling of the cabinet and the element receiving unit without using fastening members, which may achieve price reduction and increased production efficiency.

Further, due to the improved coupling structure of the cabinet and the element receiving unit, the washing machine in accordance with the example embodiments of the present disclosure may ensure easy separation/coupling of the element receiving unit and the cabinet.

Furthermore, due to the improved coupling structure of the cabinet and the element receiving unit, the washing machine in accordance with the example embodiments of the present disclosure may prevent the element receiving unit from being separated from the cabinet during operation of the washing machine.

Although the embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine, comprising:

a cabinet;

a tub placed within the cabinet;

a wash tub located within the tub to receive laundry therein;

a housing including a coupling panel coupled to one side of the cabinet, the coupling panel including a first holder and a second holder; and a receiving panel disposed at the cabinet and including a first receiving hole and a second receiving hole configured to receive the first holder and the second holder of the coupling panel, respectively, therein, wherein the first receiving hole includes a first circular portion conjoined with a second circular portion having a different size than a size of the first circular portion, and the second receiving hole includes a third circular portion conjoined with a fourth circular portion having a different size than a size of the third circular portion, wherein a distance between the first holder and the second holder corresponds to a distance between the second circular portion and the third circular portion so that after the first holder is received in the first circular portion and moved into the second circular portion, the second holder is receivable in the third circular portion, and wherein the coupling panel is pivotally rotatable with respect to the first holder after the first holder is placed in the second circular portion and the second holder is received in the third circular portion, thereby placing the second holder in the fourth circular portion so that the housing is coupled to the receiving panel.

2. The washing machine of claim 1, wherein the first circular portion and the second circular are oriented in a direction different from a direction of the third circular portion and the fourth circular portion.

3. The washing machine of claim 1, wherein at least a portion of each of the first holder and the second holder has a circular form, such that the first holder and the second holder correspond to the first receiving hole and the second receiving hole, respectively.

4. The washing machine of claim 1, wherein the first holder is located closer to a rear end of the coupling panel than the second holder.

5. The washing machine of claim 1, the coupling panel further comprising at least one protrusion protruding out from a longitudinal edge of the coupling panel.

6. The washing machine of claim 5, wherein the at least one protrusion includes a tab-shaped protrusion.

7. The washing machine of claim 6, further comprising a separation prevention bump protruding from the tab-shaped first protrusion toward the receiving panel to prevent the one of the first holder and the second holder from being separated from the the first receiving hole and the second receiving hole, respectively, when housing is coupled to the receiving panel.

8. The washing machine of claim 7, wherein upon lifting the tab-shaped first protrusion, the separation prevention bump is released from the second receiving hole.

9. The washing machine of claim 1, wherein the coupling panel is coupled to a center of the receiving panel.

10. The washing machine of claim 1, further comprising a rib protruding upward from the receiving panel to couple the housing and the coupling panel to each other as a fastening member is fastened through the rib.

11. The washing machine of claim 1, wherein the housing receives various elements required for operation of the washing machine, including a printed circuit board.

12. The washing machine of claim 1, wherein upon coupling of the coupling panel and the cabinet, the housing is prevented from being separated from the cabinet during operation of the washing machine.

* * * * *